United States Patent [19]

Fujimoto et al.

[11] 4,409,938

[45] Oct. 18, 1983

[54] IGNITION SYSTEM FOR A TWO-CYCLE ENGINE

[75] Inventors: Hiroaki Fujimoto; Ryozo Ohkita, both of Hamamatsu, Japan

[73] Assignee: Yamaha Hatsudoki Kabushiki Kaisha, Iwata, Japan

[21] Appl. No.: 300,915

[22] Filed: Sep. 10, 1981

[30] Foreign Application Priority Data

Sep. 12, 1980 [JP] Japan ..... 55-126802

[51] Int. Cl.[3] ..... F02P 9/00

[52] U.S. Cl. ..... 123/335; 123/198 F

[58] Field of Search ..... 123/198 F, 335

[56] References Cited

U.S. PATENT DOCUMENTS

| | | | |
|---|---|---|---|
| 3,868,928 | 3/1975 | Kishimoto | 123/198 F |
| 3,974,805 | 8/1976 | Kondo | 123/335 |
| 3,985,109 | 10/1976 | Kondo | 123/198 F |
| 4,252,095 | 2/1981 | Jaulmes | 123/335 |

*Primary Examiner*—Ronald B. Cox

*Attorney, Agent, or Firm*—Ernest A. Beutler

[57] ABSTRACT

An improved solid-state ignition system for a two-cycle internal combustion engine that increases scavenging and improves the smoothness of the engine during light load and low speed operation. A switch connected to the throttle valve is operative to enable a switching circuit at low throttle settings which in turn is adapted to inhibit in accordance with the firing order of the engine, the firing of each cylinder every other period so that the number of explosions is reduced by half while the intervals between explosions is maintained uniform. The switching circuit is connected to the control gates of the switching elements which control the flow of primary current to the ignition coil for each cylinder. When enabled, the switching circuit functions by periodically shorting the ignition signal applied to the gate of each switching element so that each switching element is responsive to only every second firing pulse produced by its respective sensing coil.

2 Claims, 2 Drawing Figures

IGNITION SYSTEM FOR A TWO-CYCLE ENGINE

BACKGROUND AND SUMMARY OF THE INVENTION

The present invention relates to ignition systems for internal combustion engines and in particular to a spark ignition system specifically adapted for two-cycle engines.

During the compression stroke in a two-cycle engine, a fresh fuel-air mixture is drawn into the crankcase and the spark plug is fired around the top dead center (TDC) position of the piston. On the power stroke, the fresh fuel-air mixture from the crankcase is forced into the combustion chamber and the exhaust gases from the previous combustion are accordingly forced out. This operation of expelling the exhaust gases from the combustion chamber is commonly referred to as scavenging.

Typically, the scavenging operation in two-cycle engines deteriorates during light loading and slow running operation to the extent that irregular combustions are likely to occur. More specifically, since a relatively small fuel-air mixture is being fed into a combustion chamber containing a relatively large quantity of burned gas, the fresh mixture is diluted with the residual gas so that the ignitability of the mixture is deteriorated. As a result, ignition will at times fail to take place, thus causing the engine to fire irregularly and operate in a rough manner.

Accordingly, it is the primary object of the present invention to provide an improved ignition system for a two-stroke internal combustion engine which increases the scavenging operation during low throttle operation of the engine.

In addition, it is an object of the present invention to provide an improved ignition system for a two-cycle engine that is adapted to ignite the spark plug in each cylinder only during every second compression stroke to increase the quantity of the fresh fuel-air mixture in the combustion chamber and thereby increase the scavenging operation during low throttle valve settings.

Furthermore, it is an object of the present invention to provide an improved ignition system for a two-cycle engine of the above-described type which eliminates the problem of misfiring during low throttle valve settings and insures that combustions occur at equal intervals, thus smoothing engine operation and enhancing drivability.

Additional objects and advantages of the present invention will become apparent from a reading of the detailed description of the preferred embodiment which makes reference to the following set of drawings in which:

DETAILED DESCRIPTION OF THE PREFERRED EMBODIMENT

Figure 1:
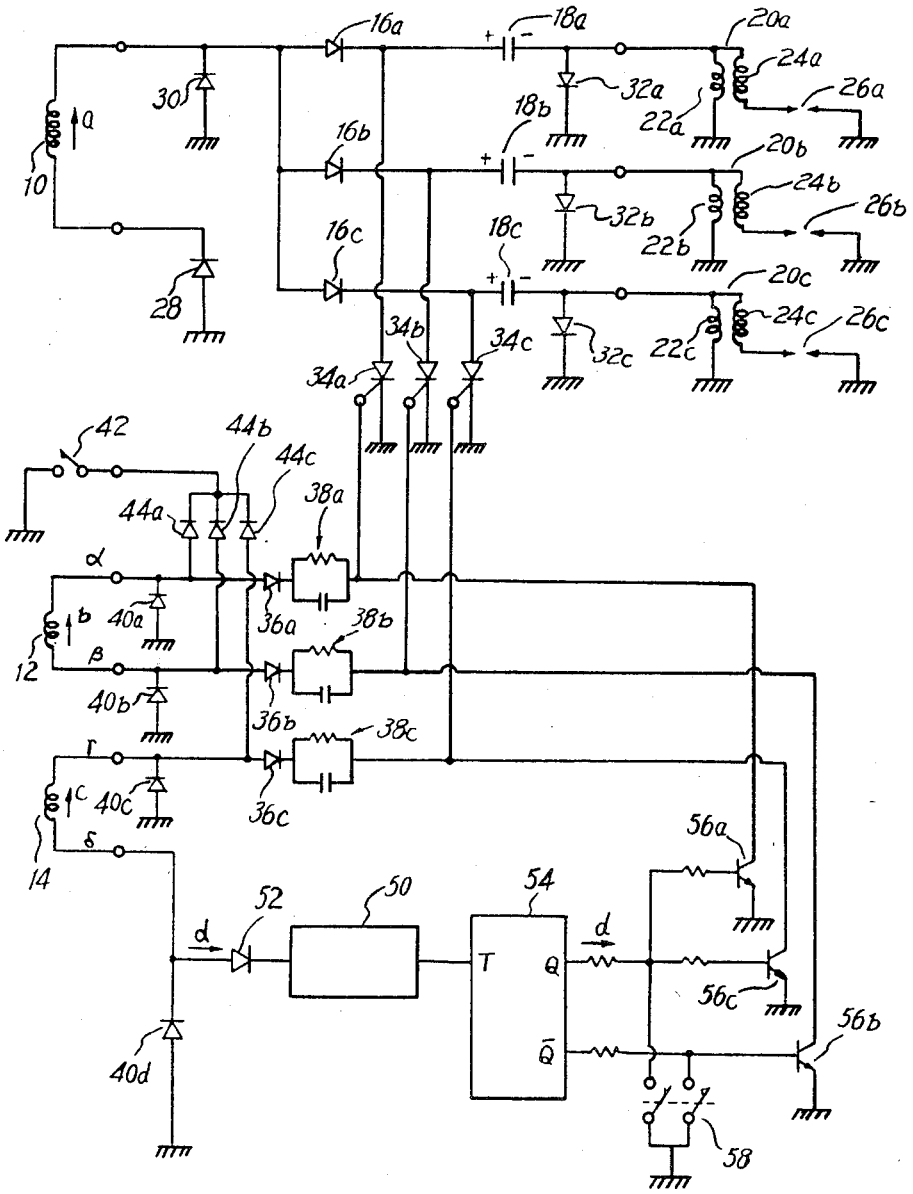
FIG. 1 is a circuit diagram of an ignition system for a two-cycle engine according to the present invention.

Referring to FIG. 1, a circuit diagram of an ignition system for a two-cycle engine according to the present invention is shown. Although the preferred embodiment described herein illustrates the use of the present invention in connection with a capacitive discharge type ignition system, it will be understood that the principles of the present invention are equally applicable to other types of ignition systems including the so-called "transistorized" ignition systems. In addition, while the preferred embodiment of the present invention described herein relates to an ignition system for a three cylinder engine, it will also be understood that the teachings of the present invention are equally applicable to two-cycle engines having a different number of cylinders.

Figure 2:
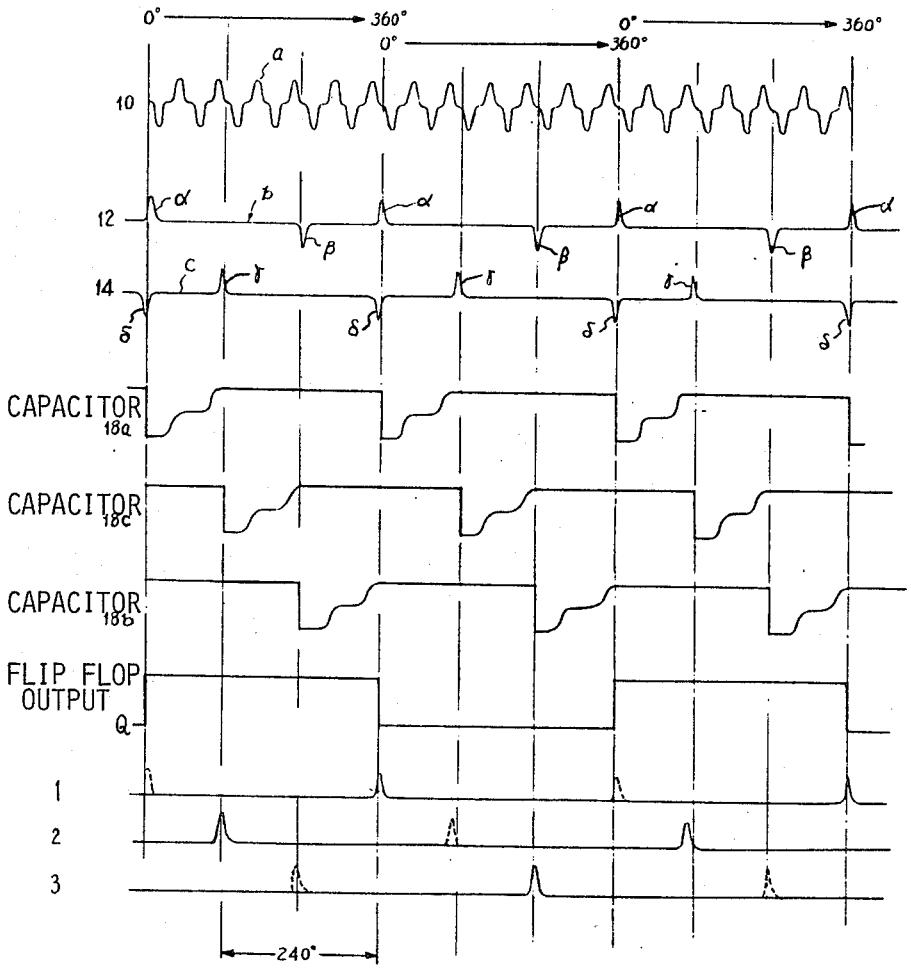
FIG. 2 is a timing diagram illustrating the relationship between various signals in the circuit diagram shown in FIG. 1.

As the crankshaft rotates, the generator 10 which is driven off the crankshaft, produces an a.c. signal waveform as shown in FIG. 2. The signal from the generator 10 is rectified by a half-wave rectifier, comprised of diodes 28 and 30, so that the positive half-waves of the generator signal charge capacitors 18*a*, 18*b* and 18*c*. Sensing coils 12 and 14 sense the rotational position of the crankshaft and serve to provide ignition signals at predetermined phase angle positions relative to the top dead center positions of the respective pistons in each cylinder. Since the particular ignition system illustrated herein is adapted for use with a three cylinder engine, the positive and negative pulses, designated "$\alpha$" and "$\beta$" respectively, from sensor 12 and the positive pulse, designated "$\gamma$", from sensor 14 are generated 120° apart.

Assuming the ignition switch 42 is ON (i.e. open), the three pulse signals "$\alpha$", "$\beta$", and "$\gamma$", from sensing coils 12 and 14 are provided via differentiating circuits 38*a*, 38*b* and 38*c* to the gates of thyristors 34*a*, 34*b* and 34*c*, respectively. Consequently, thyristors 34*a*, 34*b* and 34*c* will be sequentially turned on in the order in which the firing pulses "$\alpha$", "$\beta$" and "$\gamma$" are generated by sensing coils 12 and 14. Thus, it will be appreciated from the timing diagram in FIG. 2, that thyristor 34*c* will be rendered conductive 120° after thyristor 34*a* and 120° prior to thyristor 34*b*. As thyristors 34*a*, 34*c* and 34*b* are sequentially turned on, the charges on capacitors 18*a*, 18*c* and 18*b* are immediately discharged through primary coils 22*a*, 22*c* and 22*b*, respectively. The resulting flow of current through primary coils 22*a*, 22*c* and 22*b* induces a high voltage signal in secondary coils 24*a*, 24*c* and 24*b*, thereby sequentially firing spark plugs 26*a*, 26*c* and 26*b*, respectively. It will be noted, that when each of the capacitors 18*a*, 18*b* and 18*c* is discharged, its terminal voltage will be lower than that of the remaining two capacitors so that the charging current from generator 10 will flow into the discharged capacitor and replenish its charge. The charging voltages on capacitors 18*a*, 18*b* and 18*c* are illustrated in FIG. 2.

The gate terminal of each thyristor 34*a*, 34*b* and 34*c* is additionally tied to the collector of a transistor, 56*a*, 56*b* and 56*c* respectively, which has its emitter terminal connected to ground. The base terminals of transistors 56*a* and 56*c* are tied in common to the $\overline{Q}$ output of a T-type flip-flop 54 and the base terminal of transistor 56*b* is connected to the Q output of flip-flop 54. The base terminals of all three transistors 56*a*, 56*b* and 56*c* are also connected through a double-pole single-throw switch 58 to ground. Thus, when switch 58 is closed, transistors 56*a*, 56*b* and 56*c* are rendered nonconductive and the ignition system functions as described above. However, when switch 58 is open, the conductive conditions of transistors 56*a*, 56*b* and 56*c* are effected by the output state of flip-flop 54. Switch 58 is mechanically coupled to the throttle valve of the engine so that below a predetermined low throttle valve setting switch 58 is opened and above this predetermined throttle valve setting switch 58 is closed.

The T input of flip-flop 54 is connected to the output of a one-shot multivibrator circuit 50 which has its input in turn connected to receive the negative pulse signal, designated "δ", from sensing coil 14. Accordingly, each time a negative pulse (δ) is generated by sensing coil 14, one-shot 50 is fired and the output state of flip-flop 54 is changed. Since a negative pulse (δ) from sensing coil 14 is generated only once every 360° revolution of the crankshaft, it will be appreciated that the output state of flip-flop 54 will change with each complete revolution of the crankshaft. (FIG. 2).

Thus, assuming that the engine is operated at a low throttle valve setting and that switch 58 is open, the ignition system will function in the following manner. With the Q output of flip-flop 54 initially HI and the $\overline{Q}$ output of flip-flop 54 initially LO, transistors 56*a* and 56*c* are rendered conductive and the positive ignition pulse signals (α) and (γ) from sensing coils 12 and 14 are shorted to ground, thereby preventing thyristors 34*a* and 34*c* from firing. Hence, spark plugs 26*a* and 26*c* will not fire during this revolution. However, since the $\overline{Q}$ output of flip-flop 54 is LO, transistor 56*b* will remain nonconductive during this engine revolution, thyristor 34*b* will be triggered by ignition pulse (β) from sensing coil 12 and ignite spark plug 266. During the subsequent revolution of the crankshaft, however, the output state of flip-flop 54 will change so that its Q output will be LO and its $\overline{Q}$ will be HI, thereby rendering transistor 56*b* conductive and transistors 56*a* and 56*c* nonconductive. Accordingly, during this revolution the negative ignition pulse signal (β) from sensing coil 12 will be shorted to ground through transistor 56*b* and the positive ignition pulse signals (α and γ) from sensing coils 12 and 14 will be permitted to trigger thyristors 34*a* and 34*c* and fire spark plugs 26*a* and 26*c*, respectively. The dotted lines in the timing diagrams appearing at the bottom of FIG. 2 represent the ignition pulses that are effectively inhibited from igniting cylinders 1, 2 and 3, respectively.

Thus, it will be appreciated that during low throttle valve settings when switch 58 is open, the number 1, 3 and 2 cylinders will fire consecutively at 240° intervals so that each cylinder fires only every second revolution of the crankshaft. As noted previously, this serves to improve the scavenging operation of the engine and substantially eliminate the problem of misfiring by insuring that a sufficient quantity of fresh fuel-air mixture is present in the combustion chamber each time a cylinder is fired. Thus, the smoothness of the engine under light load and low speed conditions is significantly improved.

While the above description consitutes the preferred embodiment of the present invention, it will be appreciated that the invention is susceptible to modification, variation and change without departing from the proper scope or fair meaning of the accompanying claims.

I claim:

1. In an ignition system for a two-cycle internal combustion engine having a throttle valve and N cylinders (wherein N is a number 3 or greater), including ignition signal generating means for generating in consecutive order N firing pulse signals consisting of odd numbered and even numbered firing pulse signals at evenly spaced time intervals relative to the crankshaft position of the engine, and N switching elements each responsive to a respective one of said N firing pulse signals for igniting a respective one of said N cylinders; the improvement comprising:

a flip-flop that is toggled each complete revolution of said engine so that the Q and $\overline{Q}$ output thereof change each successive engine revolution;

N transistors each connected between one of said switching elements and ground and having the base terminals of the transistors associated with the switching elements triggered by the odd numbered firing pulse signals connected to one of the Q or $\overline{Q}$ output of said flip-flop and the base terminals of the transistors associated with the switching elements triggered by the even numbered firing pulse signals being connected to the other of said Q or $\overline{Q}$ output of said flip-flop, so that each of said transistors is rendered conductive during every second engine revolution for inhibiting every second firing pulse signal from firing its respective switching element and further so that the non-inhibited firing pulse signals remain at evenly spaced time intervals; and a switch responsive to said throttle valve for enabling said N transistors below a predetermined throttle valve setting.

2. The ignition system of claim 1 wherein said ignition signal generating means are of the electromagnetic generating type which produce both positive and negative firing pulse signals, and further wherein said flip-flop is toggled by one of said firing pulse signals.

* * * * *